US010511104B2

(12) United States Patent
Gleisberg

(10) Patent No.: US 10,511,104 B2
(45) Date of Patent: Dec. 17, 2019

(54) SOLDERABLE ELECTRIC CONNECTION ELEMENT

(71) Applicant: FEW FAHRZEUGELEKTRIKWERK GMBH & CO. KG, Zwenkau (DE)

(72) Inventor: Roy Gleisberg, Markranstädt (DE)

(73) Assignee: FEW FAHRZEUGELEKTRIKWERK GMBH & CO. KG, Zwenkau (DE)

( * ) Notice: Subject to any disclaimer, the term of this patent is extended or adjusted under 35 U.S.C. 154(b) by 0 days.

(21) Appl. No.: 16/072,754

(22) PCT Filed: Jan. 11, 2017

(86) PCT No.: PCT/EP2017/050448
§ 371 (c)(1),
(2) Date: Jul. 25, 2018

(87) PCT Pub. No.: WO2017/137200
PCT Pub. Date: Aug. 17, 2017

(65) Prior Publication Data

US 2019/0036233 A1 Jan. 31, 2019

(30) Foreign Application Priority Data

Feb. 11, 2016 (DE) ..... 10 2014 001 574
Dec. 29, 2016 (DE) ..... 10 2016 125 897

(51) Int. Cl.
*H01R 4/28* (2006.01)
*H01R 4/02* (2006.01)
(Continued)

(52) U.S. Cl.
CPC ..... *H01R 4/028* (2013.01); *H01R 4/024* (2013.01); *H01R 4/187* (2013.01); *H01R 12/53* (2013.01); *H01R 43/048* (2013.01)

(58) Field of Classification Search
CPC ..... H01R 4/028; H01R 43/0235
(Continued)

(56) References Cited

U.S. PATENT DOCUMENTS 2,451,800 A * 10/1948 Buchanan ..... H01B 17/305 439/848
2,601,276 A * 6/1952 Gordon ..... H01R 4/10 439/877
(Continued)

FOREIGN PATENT DOCUMENTS

CN 201112714 Y 9/2008 ..... H01R 12/57
DE 202013006781 U1 8/2013 ..... H05B 3/08
(Continued)

OTHER PUBLICATIONS

Notification Concerning Transmittal of International Preliminary Report on Patentability (Chapter I of the Patent Cooperation Treaty), in English, dated Aug. 23, 2018, which was issued by the International Bureau of WIPO in Applicant's corresponding international PCT application having Serial No. PCT/EP2017/050448, filed Jan. 11, 2017.
(Continued)

*Primary Examiner* — Tulsidas C Patel
*Assistant Examiner* — Peter G Leigh
(74) *Attorney, Agent, or Firm* — Bodner & O'Rourke, LLP; Gerald T. Bodner; Christian P. Bodner

(57) ABSTRACT

The invention relates to a solderable electric connection element including a crimping portion for receiving a connection cable and a soldering portion for bonding to the surface of an electrically conductive structure. The soldering portion directly adjoins the crimping portion or is offset therefrom by means of a transition portion, and a solder deposit is provided or can be placed on the solder region. According to the invention, an angled section is formed in
(Continued)

the section between the crimping and soldering region or in the transition region such that the crimping and soldering region are arranged in a back-to-back position, wherein the free face of the soldering region receives the solder deposit.

18 Claims, 3 Drawing Sheets

(51) Int. Cl.
*H01R 4/18* (2006.01)
*H01R 12/53* (2011.01)
*H01R 43/048* (2006.01)

(58) Field of Classification Search
USPC ..... 439/28
See application file for complete search history.

(56) References Cited

U.S. PATENT DOCUMENTS

| | | | | |
|---|---|---|---|---|
| 5,616,041 | A * | 4/1997 | Brown | H01R 13/113 439/222 |
| 6,103,999 | A * | 8/2000 | Nishio | H01Q 1/1278 219/203 |
| 6,162,103 | A * | 12/2000 | Ono | H01R 13/2421 439/700 |
| 6,709,300 | B1 * | 3/2004 | Brooks | H01R 13/11 439/821 |
| 7,128,623 | B2 * | 10/2006 | Kitajima | H01R 13/055 439/876 |
| 7,247,047 | B2 * | 7/2007 | Baranski | H01Q 1/1271 439/495 |
| 8,206,188 | B1 | 6/2012 | Zhang et al. | 439/862 |
| 9,509,088 | B2 * | 11/2016 | Timmermann | H01R 12/7041 |
| 9,967,967 | B2 | 5/2018 | Schmalbuch et al. | |
| 2002/0081915 | A1 | 6/2002 | Igarashi et al. | 439/830 |
| 2006/0073743 | A1 | 4/2006 | Ford et al. | 439/877 |
| 2011/0056747 | A1 * | 3/2011 | Matsushita | H01R 4/023 174/84 R |
| 2011/0109115 | A1 * | 5/2011 | Yamada | H01R 11/01 296/84.1 |
| 2014/0170913 | A1 * | 6/2014 | Degen | H05B 3/84 439/887 |
| 2015/0028084 | A1 | 1/2015 | Jenrich | 228/122.1 |
| 2015/0155646 | A1 * | 6/2015 | Takeuchi | H01R 4/04 439/78 |
| 2015/0208533 | A1 * | 7/2015 | Mai-Krist | H05B 3/08 174/50 |

FOREIGN PATENT DOCUMENTS

| | | | | |
|---|---|---|---|---|
| EP | 1381116 | A1 | 1/2004 | H01R 13/24 |
| EP | 2362491 | A1 | 8/2011 | H01R 4/18 |
| WO | WO2013124356 | A1 | 8/2013 | B23K 1/00 |

OTHER PUBLICATIONS

English translation of the International Preliminary Report on Patentability (Chapter I of the Patent Cooperation Treaty), dated Aug. 14, 2018, which was issued by the International Bureau of WIPO in Applicant's corresponding international PCT application having Seral No. PCT/EP2017/050448, filed Jan. 11, 2017.

Written Opinion of the International Searching Authority, in English, dated Apr. 20, 2017, which was issued by the International Bureau of WIPO in Applicant's corresponding international PCT application having Serial No. PCT/EP2017/050448, filed Jan. 11, 2017.

International Search Report, in English, dated Apr. 20, 2017, which was issued by the International Bureau of WIPO in Applicant's corresponding international PCT application having Serial No. PCT/EP2017/050448, filed Jan. 11, 2017.

* cited by examiner

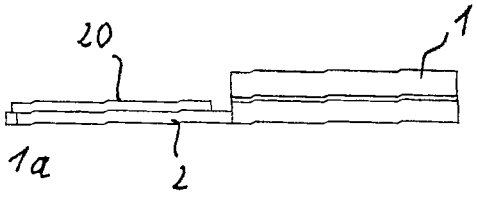
Fig. 1a
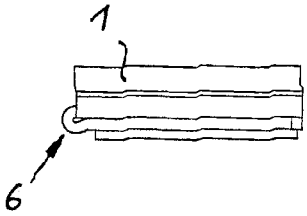
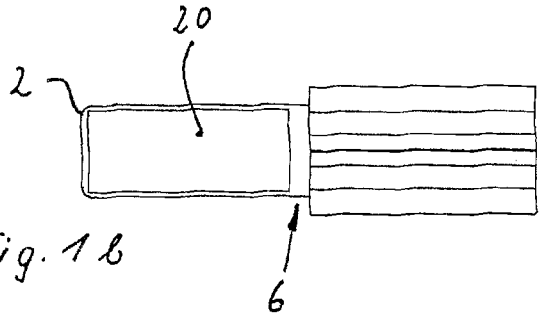
Fig. 1b
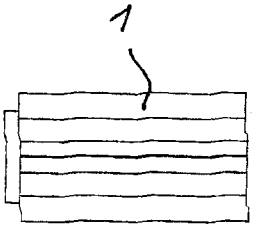
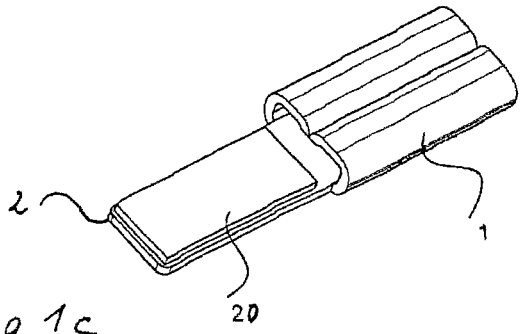
Fig. 1c
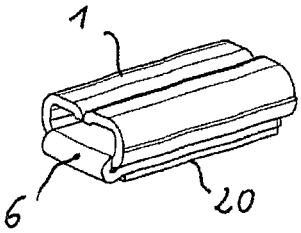

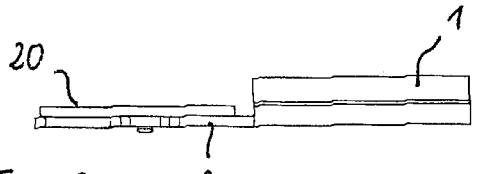
Fig. 2 a
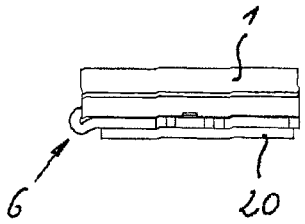
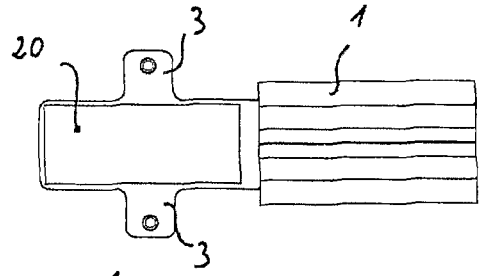
Fig 2 b
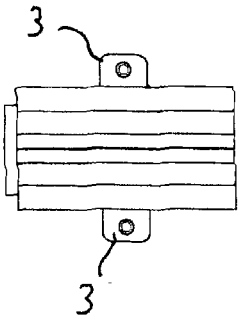
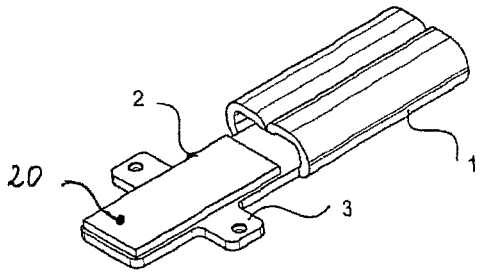
Fig. 2 c
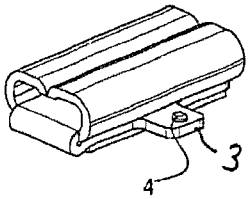

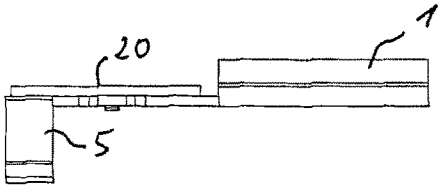
Fig. 3a
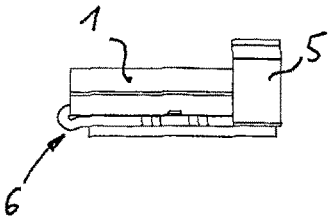
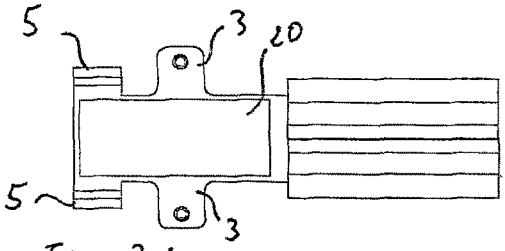
Fig. 3b
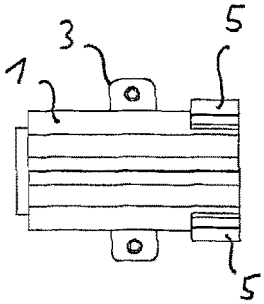
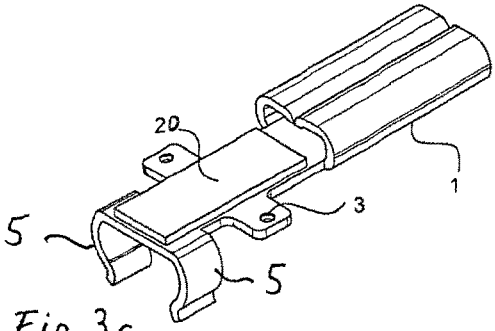
Fig. 3c
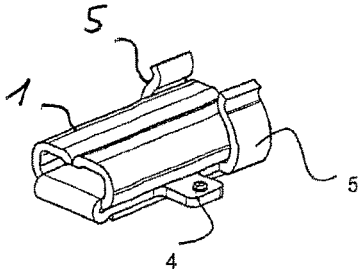

SOLDERABLE ELECTRIC CONNECTION ELEMENT

The invention relates to a solderable electrical connection element including a crimping portion for receiving a connection cable and a soldering portion to provide a bonded connection with a surface of an electrically conductive structure, wherein the soldering portion directly adjoins the crimping portion or is offset from the crimping portion by a transition portion and a solder storage is provided or providable on the soldering portion according to the preamble of patent claim 1.

An electrical connection element is known from DE 20 2013 006 781 U1. This electrical connection element is used for contacting, e.g. motor vehicle window panes with electrically conductive structures like, e.g., heating conductors or antenna conductors that are provided at this location. Electrically conductive structures of this type are typically connectible with onboard electronics through soldered electrical contact elements.

The known contact element includes a portion that is crimped about a connection cable and a soldering portion, wherein the soldering portion is connected with the electrically conductive structure through a lead-free solder material.

Thus, the electrical connecting element is connected with the connection cable through crimping. Providing crimp connections is known in the art.

In an advantageous embodiment according to DE 20 2013 006 781 U1 the soldering portion is arranged at a side of the crimped portion that is arranged opposite to the orientation of the connection cable to the external functional element. The angle between the soldering portion and the crimped portion can be between 120° and 180°.

A surface of the soldering portion that is oriented towards the substrate forms the actual contact surface between the connection element and the electrically conductive structure and is connected through a soldering material with the conductive structure.

The known connection element advantageously has the same material thickness in the solder portion and in the crimped portion. Thus, the connection element can be punched from a sheet metal material.

In another advantageous embodiment the soldering portion is configured flat to provide a flat contact surface. The soldering portion, however, can include portions that are introduced by forming like embossing or deep drawing to receive the solder storages.

The shape of the soldering portion according to DE 20 2013 006 781 U1 can be selected according to individual requirements. Polygonal, rectangular but also elliptical and also circular surfaces can be used.

In one embodiment the soldering portion is directly connected to the crimped portion of the connection element. An alternative embodiment shows a transition between the soldering portion and the crimped portion.

In addition to the crimped portion additional portions can adjoin the soldering portion. An additional portion of this type can be provided to connect the connection element with a holder.

It is known in the art to provide a contact protrusion on a surface of the soldering portion of the contact element that is oriented away from the substrate, wherein the contact protrusion is used for contacting with a soldering tool during the soldering process. The contact protrusions can be advantageously configured integral in one piece with the connection element and can be implemented by embossing or deep drawing.

The described known connection element, however, has a disadvantage in that that crimping and soldering portions that are essentially arranged in one plane occupy a larger surface which has to be considered for mounting.

Additionally there is a risk in spite of the possible transition between the soldering portion and the crimping portion that solder moves into the crimping portion when the soldering process is performed and the solder stiffens a strand end of a connection cable thus by capillary force induced penetration of the liquid solder into the spaces between the individual strands of the corresponding cable. This causes an undesirable stiffening of the cable and a resultant fracture risk.

Another risk is contaminating sections also of the crimping portion by a flux agent that is required for the soldering process.

Thus, it is an object of the invention to provide an improved solderable electrical connection element made from a crimping portion for receiving a connection cable and a soldering portion for bonded connection with the surface of an electrically conductive structure which is based on the principle of separating the crimping and soldering portion which assures that a penetration of solder into the crimping portion is prevented.

Thus, the object is achieved by a conductive electrical connection element according to the feature combination of claim 1 and by a method for producing a connection element of this type as defined in claim 10, wherein the dependent claims provide at least advantageous embodiments and improvement of the invention.

Thus, the invention is based on a solderable electrical connection element which is typically made from a metal material. The connection element includes a crimping portion for receiving a connection cable and a soldering portion for bonded connection with the surface of an electrically conductive structure, e.g., an antenna conductor or a heating conductor structure for a motor vehicle window.

The crimping portion is a portion that has sections which are configured by the forming to contact an end of an electrical connection cable, in particular of a connection strand mechanically and electrically when the end is arranged in the crimping portion.

The crimping causes a joining of the components of the connection element and of the connection cable through plastic deformation. A crimp connection is mechanically stable, difficult to disengage and provides a high level of electrical and mechanical safety. A crimping profile in the crimping portion causes the desired deformation of the connection element and conductor using a corresponding well-known tool.

The soldering portion of the connection element can include a solder depot, or it can be coated with solder, in particular it can be tin-coated. By the same token it is conceivable to apply solder, e.g., by a rivet in the soldering portion.

According to the invention a crease or an edge is formed in the section between the crimping portion and the soldering portion or a transition portion provided at this location, wherein the transition portion defines a distance between the crimping portion and the soldering portion so that the crimping portion and the soldering portion are moved into a back-to-back position as a result of the bending step, wherein the free side of the soldering portion receives the solder depot. As a result a connection element is created whose side that is oriented away from the surface of the electrically conductive structure includes the crimping portion and a soldering portion that is oriented towards the surface of the electrical structure.

Since the crimping portion and soldering portion are essentially arranged on top of each other as a result of the creasing step, this means of the bending step, and form a stack arrangement, the surface expansion of the connection element is reduced compared to the typical elongated shape.

According to an embodiment of the invention first lateral prongs extend from the soldering portion and form contact surfaces for a soldering tool. These first lateral prongs are not covered by the crimping portion after the creasing step and remain freely accessible for the actual soldering tool, e.g., for electrodes of a high frequency soldering tool.

Since the first lateral prongs extend directly from the soldering portion and are advantageously integrally configured in one piece with the soldering portion a direct heating of the soldering portion is performed without getting the topside of the crimping portion in contact with the soldering tool as required in the prior art in order to impart the required thermal energy through this portion into the soldering portion. Thus, the amount of material that has to be heated is reduced which causes a shortening of the process time for the actual soldering step.

In another embodiment of the invention two lateral tongues extend from the soldering portion in order to mechanically fix the soldering portion at the crimping portion after the creasing process. The second lateral prongs reach about the crimping portion at least partially like clamps.

Thus, the second lateral prongs with their clamp type envelopment provide additional mechanical fixing of the end of the crimping portion that is open to introduce the connection cable. An optional clamping connection of this type facilitates transferring bending forces onto the entire connection element so that improved mechanical properties are obtained.

There is a lateral distance between the first lateral prongs and the second lateral prongs wherein the second lateral prongs are advantageously arranged at or proximal to a free end of the soldering portion that is to be creased.

The surfaces of the first and second lateral prongs are configured free from flux or solder.

According to a core idea of the invention, the surface shape of the soldering portion can be selected independently from the standard configuration of the crimping portion. Thus customer requirements or the surfaces on the substrate to be contacted can be considered.

The solder depot for the actual soldering process is advantageously fixed on the soldering portion. This can be performed by, e.g., gluing, riveting or similar. In one embodiment of the invention the solder depot is applied before the bending step or in the creasing step. Alternatively a fixing of the solder depot on the free side of the solder portion can also be performed after this step.

Since the solder or the solder tin or the solder depot are not directly on the crimping portion anymore, a pre-tinning can already be performed before or parallel to the crimping process which provides parallel processing and time savings to achieve a reduction of process time.

In an embodiment of the invention the solder or crimping portion is made from different connectable materials, wherein the respective material selection is performed according to functional criteria. This means that the materials are selected for the soldering portion in order to provide optimum bonding and the material is selected for the crimping portion under the aspect of desired elastic deformation.

In view of the basic goal to use lead-free solders, a metal can be used for the solder portion which is suitable in particular for lead-free solders and which has advantages for the intended application.

In another embodiment of the invention a connection element with the features described supra is provided that is characterized by forming a strand end sleeve with a soldering tag configured as a soldering portion, wherein the soldering portion is arranged on a side that is offset from the crimping portion, in particular on the opposite side.

According to the method according to the invention for producing the connection element described supra, a stamped and bent component is initially produced from a metal material in a first fabrication step as an elongated flat piece with a crimping area and a soldering portion that is offset therefrom in the longitudinal direction.

In the next step the solder depot is applied to the surface side of the solder portion, which is arranged in the surface plane of the crimping portion.

Thereafter a creasing is performed by a bending process so that the soldering portion is brought into a back-to-back position with the substantially flat surface of a bottom side of the crimping portion.

Eventually the connection element is soldered together with the conductive structure. The crimping of the respective connection cable is performed in a known manner, thus either before or after pre-tinning the soldering portion.

The invention is subsequently described based on an embodiment with reference to drawing figures, wherein:

FIGS. 1*a* to *c* illustrate a side view, a top view, and a perspective view of an electrical connection element according to the invention in a first embodiment with a crimping and soldering portion that is initially provided as a lateral surface element (left side of the drawing figures) and corresponding illustrations after the creasing in a back-to-back position ready to solder (right side illustrations);

FIGS. 2*a* to *c* illustrate a second embodiment of the electrical connection element according to the invention with first lateral prongs for forming contact surfaces for a soldering tool before bending (left side illustrations) and after bending (right side illustrations);

FIGS. 3*a* to *c* illustrate a representation of a third embodiment similar to the representations according to FIGS. 2*a* through 2*c*, however, with an additional embodiment of second lateral prongs to provide a clamp attachment formed between the soldering portion and the crimping portion, wherein the left side illustrations according to FIGS. 3 through 3*c* illustrate the connection element in the starting condition and the right side illustrations show the connection element in a ready to solder condition.

The connection element according to the embodiment starts with a metal punched and bent component which includes a crimping portion 1 for receiving a connection cable that is not illustrated in the drawing figures and a soldering portion 2 for bonded connection with the surface of an electrically conductive structure (not illustrated).

As illustrated in the drawing figures the crimping portion 1 transitions into the soldering portion 2. A recess is provided in the transition portion 6 so that the soldering portion 2 is narrower than the width of the crimping portion 1.

A solder depot 20 is arranged on a surface of the soldering portion 2.

According to the right side illustrations according to FIGS. 1*a* through 1*c* a crease is configured in the transition portion 6 so that the crimping portion 1 and the soldering portion 2 come into a back-to back position, wherein the free side of the soldering portion 2 includes the solder depot 20.

According to the illustrations provided for the embodiment, the crimping portion and the soldering portion are separate. Thus, the soldering portion is configured as a soldering tab and connected with the crimping portion in a form of a strand end sleeve. The creasing and the bending facilitate maintaining typical dimensions of prior art strand and sleeves.

According to the embodiment according to FIGS. 2*a* through 2*c*, first lateral prongs 3 extend from the soldering portion 2 and form contact surfaces for a non-illustrated soldering tool, in particular a soldering tool for providing a resistance soldering connection.

The first lateral prongs 3 (c.f., right side illustration according to FIGS. 2*a* through 2*c*) are not covered by the actual crimping portion 1 after the creasing process and freely accessible for the soldering tool.

According to the embodiment according to FIGS. 3*a* through 3*c*, two lateral prongs 5 are provided for mechanically fixing the soldering portion at the crimping portion 1 after the creasing process in a supplemental manner or by themselves in an alternating manner.

The second prongs 5 reach around a free section of the crimping portion 1 at least partially like a clamp.

The lateral prongs 3 for forming contact surfaces for the soldering tool can have embossings 4 in order to center the tool as illustrated in FIGS. 2*c* and 3*c*.

The illustrations in FIGS. 3*a* through 3*c* also indicate an advantageous lateral distance between the first lateral prongs 3 and the second lateral prongs 5 to provide interlocking attachment.

Though the soldering portion is essentially shaped rectangular in the illustrations according to the first through the third embodiment, also here other surface shapes, e.g., circular shapes, oval or polygonal surfaces are conceivable.

According to the illustrated embodiments, the soldering tin or a solder depot are not arranged directly on the crimping portion anymore. Thus, pre-tinning can also be performed before or after the crimping process.

The design according to the invention effectively prevents a contamination of the backside of the soldering portion with flux agent.

Due to parallel processing the backside can be cleared from flux agent and the front side can be provided with the flux agent without losing time. Since the crimp contacts, this means the connection elements, for the crimping process, are individualized quite well by a conveyor belt contrary to the time after the crimping process, additional process steps like pre-tinning or cleaning can be easily performed upon the crimp in an automated manner.

Due to the face that the soldering tin or the solder depot are not arranged directly on the crimp or in the crimping portion anymore, there is the option to fix the solder depot mechanically, e.g., by riveting or other technologies on the solder portion.

The lateral prongs or lugs facilitate positioning the soldering tool in an optimum manner on the element. Also these lateral prongs can be designed customer-specific as contact surfaces for a soldering tool. By using the lateral prongs as contact surfaces for a soldering tool, less material has to be heated so that fabrication time is reduced.

Since contrary to known strand end sleeves the connection cable strand is separate from the soldering portion, the usual problem is circumvented where solder is pulled into the strand during the soldering process on the substrate, in particular on a window pane with the consequence that the soldering tin solidifies in the strand and stiffens the strand. According to the prior art this has disadvantages when handling the window and installing it in the vehicle. Breaking the strand off from the strand end sleeve is thus prevented.

The optional configuration of the second prongs for clamp type envelopment can transfer bending forces upon the entire connection element which improves long-term stability of the contacts.

The invention claimed is:

1. A solderable electrical connection element formed by the steps of:

fabricating a stamped and bent component from a metal material as an elongated surface element with a crimping portion and a soldering portion that is offset from the crimping portion in a longitudinal direction;

applying or attaching a solder depot to a surface side of the solder portion which is arranged in the surface plane of the crimping portion;

generating a crease by a bending process so that the soldering portion moves into a back to back position with a substantially flat surface of the crimping portion; and soldering the connection element together with a conductive structure and performing a crimp attachment process of a respective connection cable in an known manner before or after tinning the soldering portion;

wherein the solderable electrical connection element comprises:

a crimping portion (1) for receiving a connection cable and a soldering portion (2) for bonding to a surface of an electrically conductive structure, wherein the soldering portion (2) directly adjoins the crimping portion (1) or is offset from the crimping portion (1) by a transition portion (6), and wherein a solder depot (20) is provided at or attachable at the soldering portion (2), characterized in that a crease is configured in a section between the crimping portion and the soldering portion (1; 2) or in the transition portion (6) so that the crimping and soldering portion (1; 2) are arranged back to back, wherein a free side of the soldering portion (2) receives the solder depot (20).

2. The connection element according to claim 1, characterized in that first lateral prongs (3) extend from the soldering portion (2) in order to form contact surfaces for a soldering tool, wherein the contact surfaces are not covered by the crimping portion (1) after the creasing process and are accessible for the soldering tool.

3. The connection element according to claim 2, characterized in that the surfaces of the first and second lateral prongs (3; 5) are free from the solder depot.

4. The connection element according to claim 1, characterized in that second lateral prongs (5) extend from the soldering portion (2) for mechanically fixing the solder portion (2) at the crimping portion (1) after the creasing process, wherein the second lateral prongs (5) envelop the crimping portion (1) at least partially in a clamping manner.

5. The connection element according to claim 4, characterized in that a lateral distance is provided between the first lateral prongs (3) and the second lateral prongs (5).

6. The connection element according to claim 1,
characterized in that the surface shape of the solder portion (2) is arbitrarily selectable.

7. The connection element according to claim 1,
characterized in that the solder depot (20) is mechanically fixed at the solder portion (2).

8. The connection element according to claim 1,
characterized in that the solder and the crimp portion (2; 1) are made from different connectable materials, wherein the respective material selection is performed from a functional point of view, this means to provide good bonding for the soldering portion (2) and good deformation for the crimping portion (1).

9. The connection element according to claim 1,
characterized in that the connection element is formed as a strand end sleeve with a soldering tab as a soldering portion (2),
wherein the solder depot (20) is on a side that is offset from the crimping portion (1), in particular arranged opposite thereto.

10. A method for producing a solderable electrical connection element, the solderable electrical connection element comprising a crimping portion (1) for receiving a connection cable and a soldering portion (2) for bonding to a surface of an electrically conductive structure, wherein the soldering portion (2) directly adjoins the crimping portion (1) or is offset from the crimping portion (1) by a transition portion (6), and wherein a solder depot (20) is provided at or attachable at the soldering portion (2), characterized in that a crease is configured in a section between the crimping portion and the soldering portion (1; 2) or in the transition portion (6) so that the crimping and soldering portion (1; 2) are arranged back to back, wherein a free side of the soldering portion (2) receives the solder depot (20), the method comprising the steps:
fabricating a stamped and bent component from a metal material as an elongated surface element with a crimping portion and a soldering portion that is offset from the crimping portion in a longitudinal direction;
applying or attaching a solder depot to a surface side of the solder portion which is arranged in the surface plane of the crimping portion;
generating a crease by a bending process so that the soldering portion moves into a back to back position with a substantially flat surface of the crimping portion; and
soldering the connection element together with a conductive structure and performing a crimp attachment process of a respective connection cable in an known manner before or after tinning the soldering portion.

11. The method for producing a solderable electrical connection element as defined by claim 10,
characterized in that first lateral prongs (3) extend from the soldering portion (2) in order to form contact surfaces for a soldering tool,
wherein the contact surfaces are not covered by the crimping portion (1) after the creasing process and are accessible for the soldering tool.

12. The method for producing a solderable electrical connection element as defined by claim 11,
characterized in that the surfaces of the first and second lateral prongs (3; 5) are free from the solder depot.

13. The method for producing a solderable electrical connection element as defined by claim 10,
characterized in that second lateral prongs (5) extend from the soldering portion (2) for mechanically fixing the solder portion (2) at the crimping portion (1) after the creasing process,
wherein the second lateral prongs (5) envelop the crimping portion (1) at least partially in a clamping manner.

14. The method for producing a solderable electrical connection element as defined by claim 13,
characterized in that a lateral distance is provided between the first lateral prongs (3) and the second lateral prongs (5).

15. The method for producing a solderable electrical connection element as defined by claim 10,
characterized in that the surface shape of the solder portion (2) is arbitrarily selectable.

16. The method for producing a solderable electrical connection element as defined by claim 10,
characterized in that the solder depot (20) is mechanically fixed at the solder portion (2).

17. The method for producing a solderable electrical connection element as defined by claim 10,
characterized in that the solder and the crimp portion (2; 1) are made from different connectable materials, wherein the respective material selection is performed from a functional point of view, this means to provide good bonding for the soldering portion (2) and good deformation for the crimping portion (1).

18. The method for producing a solderable electrical connection element as defined by claim 10,
characterized in that the connection element is formed as a strand end sleeve with a soldering tab as a soldering portion (2),
wherein the solder depot (20) is on a side that is offset from the crimping portion (1), in particular arranged opposite thereto.

* * * * *